United States Patent [19]

Avramidis

[11] Patent Number: 4,832,577

[45] Date of Patent: May 23, 1989

[54] VORTEX PUMP

[76] Inventor: Anestis S. Avramidis, 6608 N. Campbell, Chicago, Ill. 60645

[21] Appl. No.: 78,794

[22] Filed: Jul. 27, 1987

[51] Int. Cl.[4] ..... F04F 5/02; F04F 5/14

[52] U.S. Cl. ..... 417/172; 417/183

[58] Field of Search ..... 417/118, 172, 183

[56] References Cited

U.S. PATENT DOCUMENTS

| | | | |
|---|---|---|---|
| 47,793 | 5/1865 | Brear | 417/172 |
| 204,725 | 6/1878 | Gunning | 417/172 |
| 919,416 | 4/1909 | Boulicult | 417/118 |
| 981,716 | 1/1911 | Tait | 417/172 |
| 1,845,675 | 2/1932 | Martin | 417/172 X |
| 2,463,317 | 3/1949 | Sanders | 417/172 |
| 2,909,127 | 10/1959 | Bradaska | 417/172 |
| 3,718,407 | 2/1973 | Newbrough | 417/172 X |
| 3,991,825 | 11/1976 | Morgan | 417/118 X |
| 4,625,807 | 12/1986 | Harlow | 417/118 X |

FOREIGN PATENT DOCUMENTS

| | | | |
|---|---|---|---|
| 628262 | 10/1927 | France | 417/172 |

*Primary Examiner*—William L. Freeh

[57] ABSTRACT

Pumping system that uses compressed air to pump fluids continuously without inducing disturbances to the surrounding hydrologic regime. The suction source of the pumping system is the vacuum-drawing effect of a vortex created by a reflected air stream on an air reflector. The projected air stream on the air reflector is provided through the annular space between the inner and the outer tubing of a coaxial hose, and the reflected air stream carrying the effluent is discharging through the inner tubing of the coaxial hose. The flow of the projected and the reflected air streams is independently controlled using a coaxial hose splitter. Solid particles in the influent are filtered prior to entering the pumping system, and the effluent is separated upon discharge using separators.

3 Claims, 6 Drawing Sheets

VORTEX PUMP

CROSS REFERENCE TO RELATED APPLICATIONS

In various Civil-Environmental Engineering projects wherein assessment of the ground water quality is to be made, it becomes necessary to collect ground water samples for subsequent chemical analysis.

In common practice, water samples representing water in the pores of a geologic formation are collected from monitoring wells installed in the particular formation. The quality of the water samples however, may greately be affected by the presence of stagnant water in the monitoring well. To assure collection of high quality water samples, it is required that stagnant water be purged (removed) entirely or partially from the monitoring well prior to sample collection. Depending on the hydrogeologic characteristics of the geologic formation, well purging may become possible by pumping the well dry, or by pumping well water equivalent to a specified number of volumes of the stagnant well water.

Various types of devices/methods are available for purging monitoring wells, for example: hand bailers, positive displacement bladder pumps, air lifting. Among the disadvantages of all available methods however are: the introduction of undesirable disturbances in the hydrologic regime around the well screen, their low pumping rate associated particularly with deep monitoring wells, and their high initial cost. It therefore is the purpose of the present invention to provide a pumping system that among its other uses it may be used for more efficient and cost effective monitoring well purging.

BRIEF SUMMARY OF INVENTION

The pumping system of the present invention employes a coaxial hose that supplies compressed air to the pumping device and discharges the effluent. The pumping device consists of an outer tube at the bottom of which the air reflector is connected. A ball check valve connected at the bottom of the air reflector assures one way flow of the influent. Inside the outer tube of the pumping device and above the air reflector, an inner tube is disposed coaxially. The inner and the outer tubes of the pumping device are connected to the inner and outer tubings of the coaxial hose respectively.

Compressed air supplied through the annular space between the inner and the outer tubes of the pumping device, is projected on the air reflector and the reflected air stream discharges through the inner tube. As the air stream is reflected on the air reflector, it creates a vortex with vacuum suction above the check valve. This suction opens the check valve and allows the influent to flow into the inner tube and hence be discharged under pressure by the reflected air stream. A screen surrounding the inlet of the check valve provides influent free of solids.

Among the objects of the invention are the provision of a low cost pumping system that uses compressed air and discharges effluent continously; the provision of a pumping system that uses as suction source the vortex created by a reflected air stream, the provision of a pumping system that induces no disturbances to the surrounding hydrologic regime, the provision of a pumping system having a coaxial hose that carries the projected and reflected air streams; the provision of a pumping system having a coaxial hose splitter that provides independent control of flow of the projected and reflected air streams and the provision of a pumping system that may pump fluids selectively from any specified zone within the body of the influent.

These and other objects and advantages of the invention will become more apparent as the description proceeds and when considered in conjunction with the accompanying drawings.

DETAILED DESCRIPTION

Figure 1:
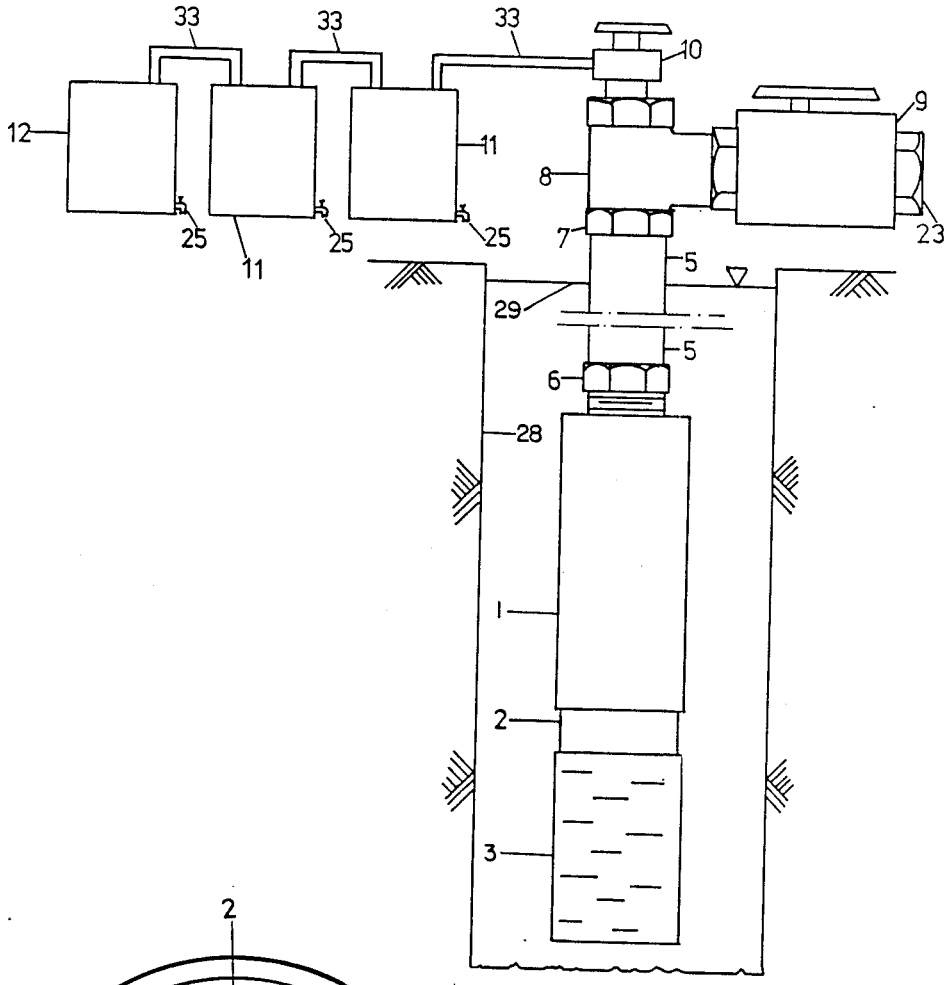
FIG. 1 is a general view of the assembled pumping system inside a monitoring well, indicating relative positions of the component parts.

In the drawings which illustrate the pumping system of the present invention, the same reference numerals have been used to refer to similar details throughout the several views.

In FIG. 1, the pumping system is shown with its screen 3 submerged in the (influent) stagnant water 29 of the monitoring well 28.

Figure 3:
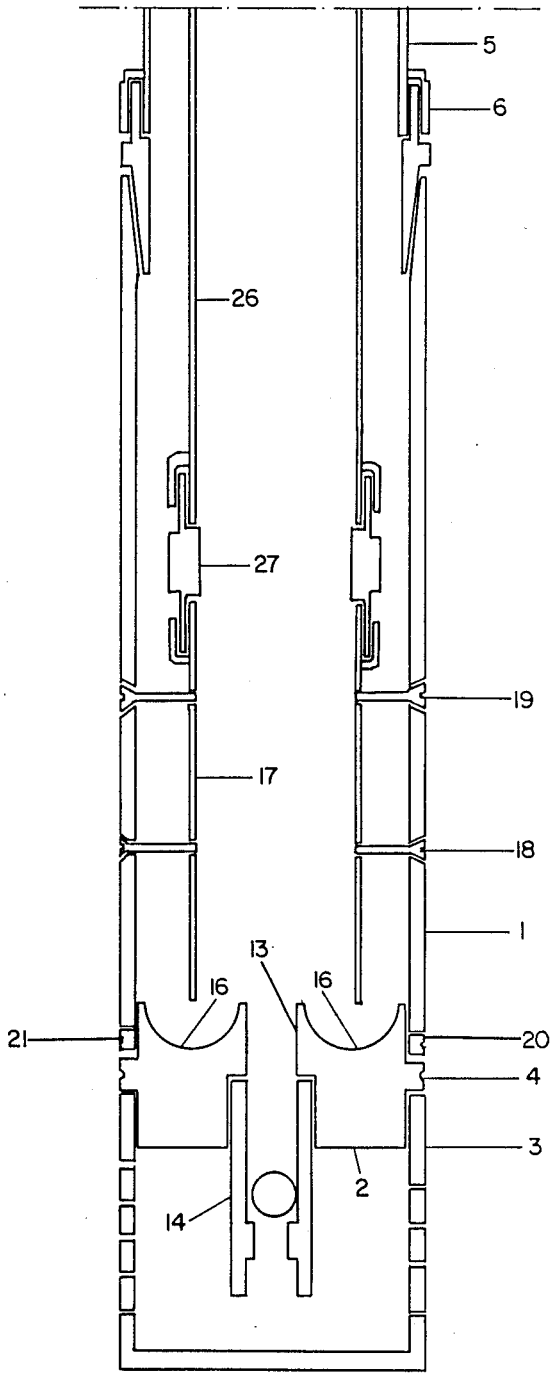
FIG. 3 is a sectional view taken on line 3—3 of FIG. 2, showing the relative position of the air reflector to the inner and outer tubes of the pumping device, check valve, screen, and the respective connections of the inner and outer tubes of the pumping device to the inner and outer tubings of the coaxial hose.
Figure 4:
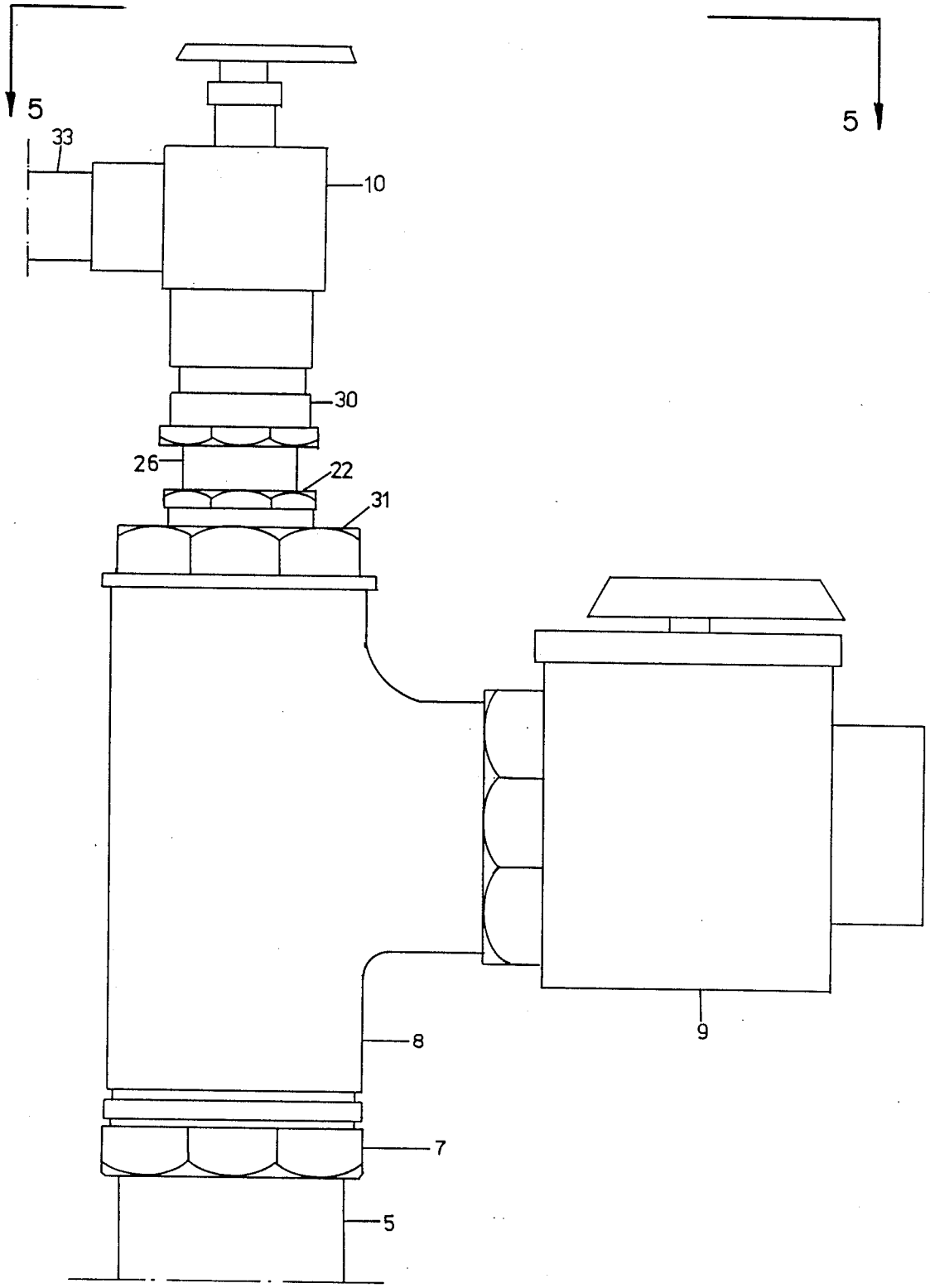
FIG. 4 is an elevation view of the coaxial hose splitter including the projected and reflected air stream control valves.

In FIG. 3, the outer tube 1 of the pumping device which may be of stainless steel, is threaded and mounted securely onto the air reflector 2.

Figure 2:
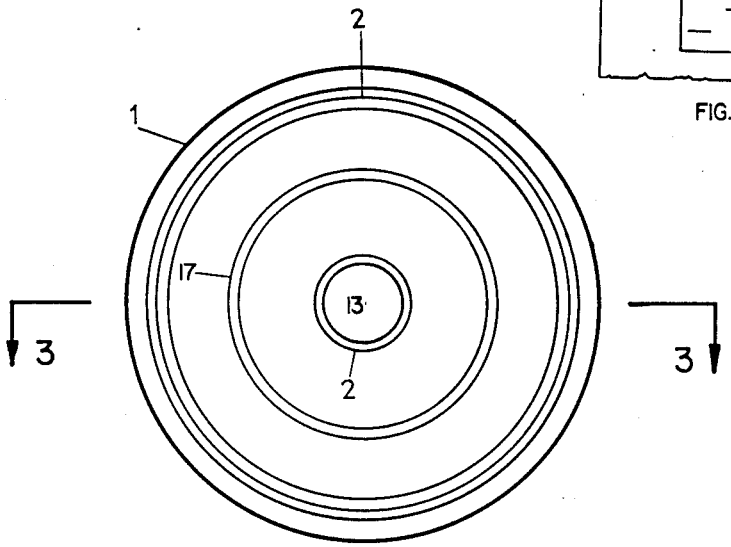
FIG. 2 is a plan view of the top surface of the air reflector including the inner and outer tubes of the pumping device, with the check valve and the screen removed.

As a significant feature of the present invention, best seen in FIG. 2 and FIG. 3, the air reflector 2 which may be of stainless steel is a cylindrical member threaded at both ends. At its bottom end the screen 3 is mounted securely. The air reflector 2 has four holes 4 around the midheight periphery of its outer surface and 90 degrees apart, for positioning the tightening wrench during mounting the air reflector 2 to the outer tube 1 of the pumping device and to the screen 3. The air reflector 2 has a passage 13 along its axis at the bottom end of which a ball check valve 14 which may be of stainless steel with teflon ball is mounted by any suitable means such as threads. The check valve 14 has suitable stop means (not shown) for preventing escape of the ball from passage 13. At the upper surface of the air reflector 2, a round groove 16 with semicircular shape is opened centrically. The centers of the semicircular groove taken on a radial cross section lie on a circle with diameter approximately equal to the outer diameter of the inner tube 17 of the pumping device.

The relative position of the inner tube 17 to the outer tube 1 of the pumping device along the longitudinal direction may be maintained fixed, and along the radial direction may be adjusted and maintained coaxial, by any suitable means such as using four screws 18 close to the bottom end and four screws 19 close to the top end of the inner tube 17 of the pumping device. The screws in each set 18 and 19 are positioned 90 degrees apart, are countersink through the outer tube 1 of the pumping device, and are threaded onto the inner tube 17 of the pumping device.

For an optimum pumping efficiency, the relative position of the inner tube 17 of the pumping device with respect to the air reflector 2 along the longitudinal direction may be adjusted by any suitable means such as by screwing the air reflector 2 in or out of the outer tube 1 of the pumping device, and maintained by any suitable means such as using the lock nut 20. Lock nut 20 has four holes 21 on its outer surface 90 degrees apart that may be used for positioning a tightening wrench.

The screen 3 which may be of stainless steel may be selected so that it will filter the influent from solid particles of up to certain size.

Figure 5:
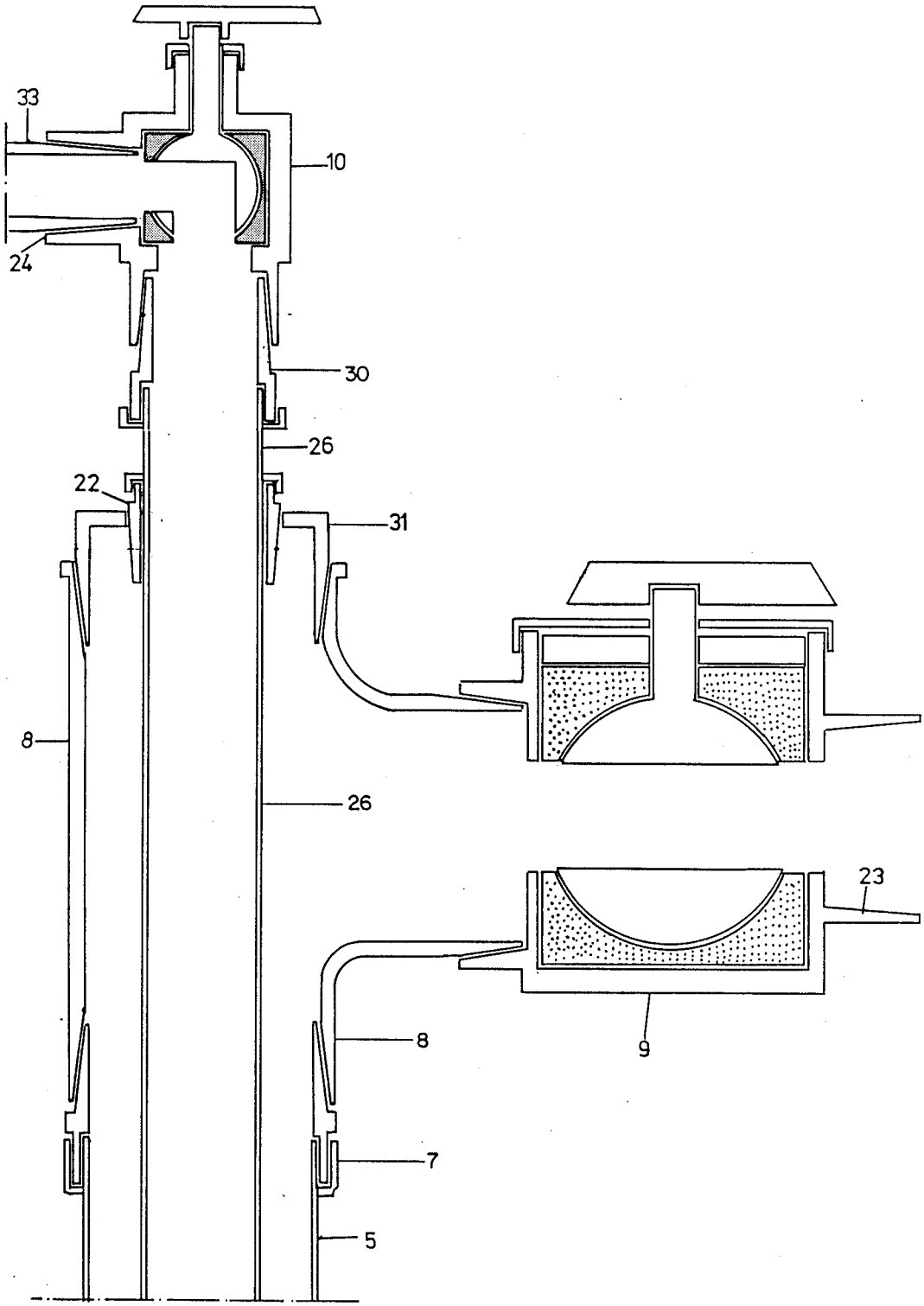
FIG. 5 is a sectional view taken along line 5—5 of FIG. 4, showing the relative connections of the outer and inner tubing of the coaxial hose to the coaxial hose splitter, and the projected and reflected air stream control valves.
Figure 6:
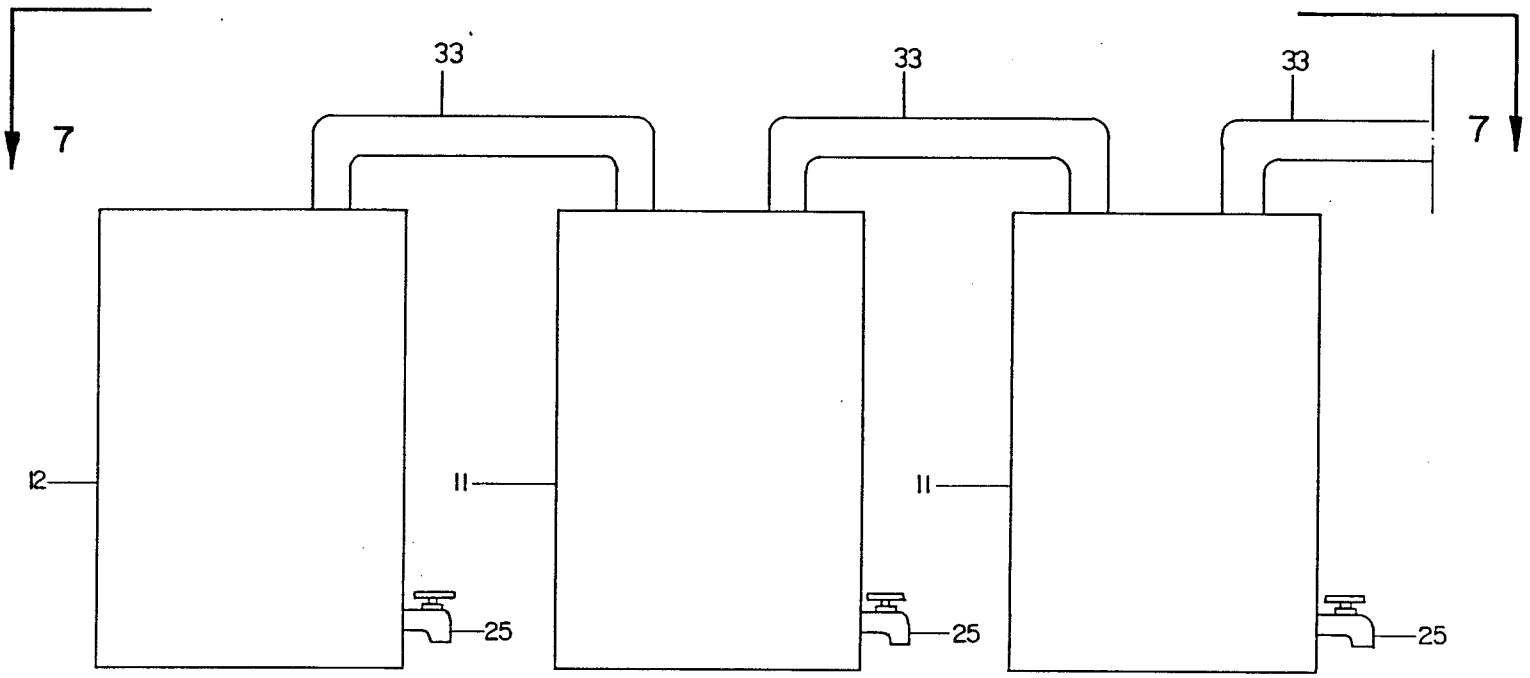
FIG. 6 is an elevation view of the separators and the respective connections.
Figure 7:
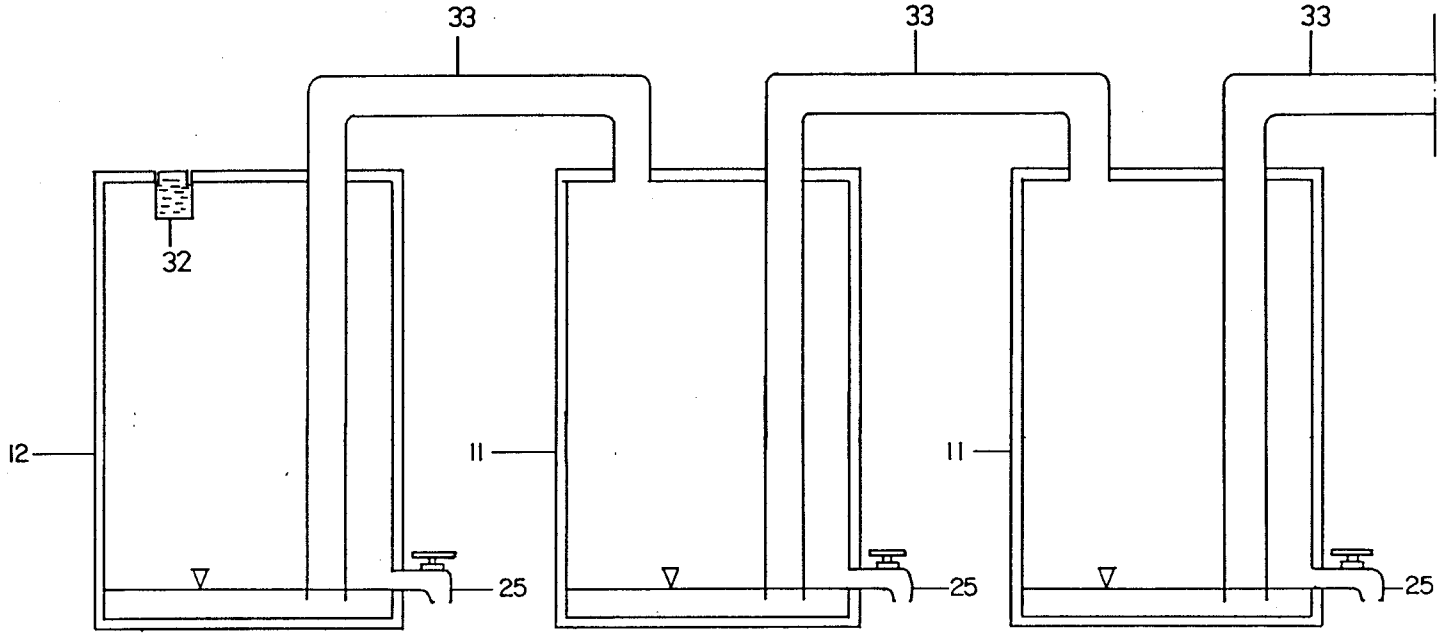
FIG. 7 is a sectional view taken along line 7—7 of FIG. 6.

The outer tubing 5 of the coaxial hose may be connected to the outer tube 1 of the pumping device, and to the bottom end of the tee pipe fitting 8 of the coaxial hose splitter by any suitable means such as pipe to tubing connectors 6 and 7 respectively as shown in FIG. 3 and FIG. 5. The inner tubing 26 of the coaxial hose may be connected to the inner tube 17 of the pumping device, and to the top end of the tee pipe fitting 8 of the coaxial hose splitter by any suitable means such as tubing to tubing connector 27, and a reducer 31 and tubing to pipe connector 22 respectively as shown in FIG. 3 and FIG. 5. The inner tubing 26 of the coaxial hose taken on a radial cross section the top end of the tee pipe fitting 8 of the coaxial hose splitter, and it is connected to the reflected air stream control valve 10 with any suitable means such as tubing to pipe fitting 30 as shown in FIG. 5. The projected air stream control valve 9 is connected to the side end of the tee pipe fitting 8 of the coaxial hose splitter as shown in FIG. 5 by any suitable means such as threads. The function of the coaxial hose splitter will become more apparent in the description of the operation of the pumping system. The effluent carried by the reflected air stream is separated from the air stream by any suitable means such as by passing the reflected air stream through one or more separators 11 connected in series by any suitable means such as pipes 33 as shown in FIG. 6 and FIG. 7. The last of such separators 12 may be exhausting through a filter 32 to the atmosphere.

A controlled supply of pressurized air is connected to the inlet 23 of the projected air stream control valve 9, and the outlet 24 of the reflected air stream control valve 10, is connected to the separator 11 by any suitable means such as pipe 33. Each separator 11 and 12 has at its side and close to its bottom a drainage valve 25.

To operate the pumping device of the present invention the following steps may be followed after its efficiency has been adjusted to the optimum as described earlier.

1. Establish all appropriate connections prior to submerging the pumping device into the influent.
2. Apply pressurized air inside the pumping device by opening the projected air stream control valve 9, and closing the reflected air stream control valve 10 as shown in FIG. 1 and FIG. 5.
3. Submerge the pumping device to the selected pumping depth into the monitoring well 28, as shown in FIG. 1. Under pressurization inside the pumping device, the ball check valve 14 remains closed obstracting thus the entrance of influent into the pumping device.
4. Open the reflected air stream control valve 10 to commence pumping.
5. Cease pumping operation by closing the reflected air stream control valve 10 and keeping open the projected air stream control valve 9. This way all influent inside the pumping system is retained and may be extracted by reopening valve 10 after the pumping system has been removed from the monitoring well.
6. Close projected air stream control valve 9.

Having thus described a preferred form of the pumping system, it will be understood that the invention may be in other forms than that described as being the preferred form and without departing from the scope of the invention as defined by the appended claims.

What is claimed is:

1. Pumping system comprising: a first housing having an opening for receiving pressurized fluid; a second housing disposed inside said first housing and having an inlet and an outlet; said second housing including a cylindrical segment for defining said inlet; fluid reflecting means for reflecting said pressurized fluid into said inlet of said second housing and creating a vacuum drawing effect acting on an influent; said fluid reflecting means include an annular groove with curved cross section for receiving said pressurized fluid and reflecting it inside said inlet of said second housing; said fluid reflecting means include passage means for receiving the influent; said fluid reflecting means positioned adjustably with respect to said inlet of said second housing; said inlet of said second housing being disposed concentrically with said annular groove and at a predetermined distance above the bottom of the groove; said pressurized fluid and said influent being mixed at the inlet of said second housing.

2. The pumping system of claim 1 further comprising means for filtering said influent; said filtering means disposed at said opening of said first housing.

3. The pumping system of claim 2 further comprising separator means for separating said influent from said influent-pressurized fluid mixture; said separator means include a tank containing influent retaining means; said tank having an opening for receiving said influent-pressurized fluid mixture exiting said outlet of said second housing; and means for directing said influent-pressurized fluid mixture through said influent retaining means for the purpose of retaining said influent of said influent-pressurized fluid mixture by said influent retaining means.

* * * * *

UNITED STATES PATENT AND TRADEMARK OFFICE

CERTIFICATE OF CORRECTION

PATENT NO. : 4,832,577

DATED : May 23, 1989

INVENTOR(S) :Anestis S. Avramidis

It is certified that error appears in the above-identified patent and that said Letters Patent is hereby corrected as shown below:

Col. 3, line 38, delete "taken on a radial cross section" and substitute therefor --exits at--.

Signed and Sealed this

Twelfth Day of June, 1990

*Attest:*

HARRY F. MANBECK, JR.

*Attesting Officer*

*Commissioner of Patents and Trademarks*